US005667927A

United States Patent [19]

Kubota et al.

[11] Patent Number: 5,667,927

[45] Date of Patent: Sep. 16, 1997

[54] TONER FOR ELECTROPHOTOGRAPHY AND PROCESS FOR THE PRODUCTION THEREOF

[75] Inventors: Hideyuki Kubota, Shizuoka; Eiichi Ozeki, Kyoto, both of Japan

[73] Assignees: Shimadu Corporation, Tokyo; Tomoegawa Paper Co., Ltd., Kyoto, both of Japan

[21] Appl. No.: 605,962

[22] Filed: Feb. 23, 1996

Related U.S. Application Data

[63] Continuation-in-part of Ser. No. 297,897, Aug. 30, 1994, abandoned.

[30] Foreign Application Priority Data

Aug. 30, 1993 [JP] Japan ..... 5-235939
Aug. 2, 1994 [JP] Japan ..... 6-200250

[51] Int. Cl.[6] ..... G03G 9/087

[52] U.S. Cl. ..... 430/109; 430/106; 430/110

[58] Field of Search ..... 430/109, 110

[56] References Cited

U.S. PATENT DOCUMENTS 4,777,104 10/1988 Matsumoto et al. ..... 430/137
5,004,664 4/1991 Fuller et al. ..... 430/109
5,208,131 5/1993 Felder et al. ..... 430/114
5,387,665 2/1995 Misawa et al. ..... 528/354

FOREIGN PATENT DOCUMENTS

WO92/01245 1/1992 WIPO .

*Primary Examiner*—Roland Martin
*Attorney, Agent, or Firm*—Wenderoth, Lind & Ponack

[57] ABSTRACT

A biodegradable or hydrolyzable toner for electrophotography, which permits the easy reclaiming and recycling of used copying paper, permits the easy deinking by an existing deinking system, can decrease environmental pollution caused by a toner waste, and has excellent toner properties owing to the uniform dispersion of additives, the toner containing, as a binder resin, a lactic acid-based resin of the formula (1), $$H-[-O-CH(CH_3)-CO-]_n-OR \quad (1)$$

wherein R is an alkali metal or an alkaline earth metal, and n is an integer of 10 to 20,000.

8 Claims, No Drawings

TONER FOR ELECTROPHOTOGRAPHY AND PROCESS FOR THE PRODUCTION THEREOF

This application is a continuation-in-part of now abandoned application, Ser. No. 08/297,897 filed Aug. 30, 1994, abandoned.

FIELD OF THE INVENTION

The present invention relates to a toner for electrophotography. More specifically, it relates to a toner for electrophotography, which has hydrolyzability and biodegradability and permits facile deinking (removal of ink) with an existing deinking system, and which can be easily waste-treated.

PRIOR ART OF THE INVENTION

In recent years, with a view to both environmental protection and waste treatment, i.e., the protection of forest resources and the prevention of global warming, it is actively promoted worldwide to use waste paper. For promoting the use of waste paper, there are methods in which the content of a deinked pulp in reclaimed paper is increased and the process of incorporating a deinked pulp into wood-free paper and paper for the information industry is developed. For this purpose, it is required to improve the quality of a deinked pulp obtained from waste paper from printed matter such as newspaper, magazines, and the like, by increasing the deinking ratio and dustproof ratio of the deinked pulp.

Meanwhile, copying machines and printers using electrophotographic systems are now widely used, and the waste of used copying paper is increasing in amount. It has been therefore proposed to attempt to obtain a deinked pulp from used copying paper. In copying paper, however, a toner composed mainly of a colorant and a binder resin is strongly adhering to a paper surface, and it is difficult to regenerate a high-quality deinked pulp by a conventional deinking treatment method.

In view of the protection of global environment, the safety of waste is also an important issue. In Italy, a tax on non-decomposable shopping bags has been enforced since 1987 for overcoming the problem of plastic waste, and a law has been issued which provides that shopping bags and bottles are to be produced from biodegradable materials from 1991 onward. Further, regulations against the use of plastics or bills for the conversion of materials to decomposable polymers are studied in other European countries and some States of the U.S.A.

Under the circumstances, developments of biodegradable resins are now under way, and biodegradable resins for medical materials have been put to practical use to a considerable extent. In the field of agriculture, biodegradable materials are practically used as multifiles, sustained-releasable agrochemicals, fertilizers and gardening tools. In the leisure industry, some fishing lines, fishing tackle and tees for golfing are practically produced from biodegradable materials. Further, some of the packaging materials for daily necessities such as containers are practically produced from biodegradable materials.

A toner waste from used copying paper or an electrophotographic process is also required to be free of problems when disposed of. JP-A-4-179967 discloses a toner containing a specific polyester-based biodegradable binder resin. However, this toner has high humidity absorption properties and is unstable in chargeability, and it further has a problem in that it has insufficient deinking properties due to its insolubility in an alkali solution.

A conventional toner for electrophotography is generally produced as follows. A binder resin, a colorant, an offset preventer and other optional additives as components for the toner are mixed in advance. The resultant mixture is kneaded while the binder resin is melted by heating the mixture, to obtain a mass, and the mass is pulverized to obtain a toner having a desired particle diameter. However, in the above conventional production method, the dispersibility of the additives in the binder resin is poor when the mixture is kneaded while the binder resin is melted. It is therefore required to employ very severe conditions for the melt-kneading. Further, the toner sometimes has a problem in properties for practical use such as uniform chargeability and offset prevention properties.

SUMMARY OF THE INVENTION

It is an object of the present invention to provide a toner for electrophotography, which permits the easy reclaiming and recycling of used copying paper, and a process for the production of said toner.

It is another object of the present invention to provide a toner for electrophotography, which permits the easy deinking by an existing deinking system, and a process for the production thereof.

It is further another object of the present invention to provide a toner for electrophotography, which can decrease environmental pollution caused by toner waste, and a process for the production thereof.

It is still further another object of the present invention to provide a toner for electrophotography, which has excellent toner properties owing to the uniform dispersion of additives, and a process for the production thereof.

According to the present invention, there is provided a toner for electrophotography, which contains, as a binder resin, a lactic acid-based resin of the formula (1), $$H—[—O—CH(CH_3)—CO—]_n—OR \quad (1)$$

wherein R is an alkali metal or an alkaline earth metal, and n is an integer of 10 to 20,000, said resin being produced by bulk-polymerizing lactic acid in the presence of at least one additive selected from the group consisting of a colorant, a charge control agent and an offset preventer;

said toner being produced by heat-melting and kneading said resin or a mixture of said resin with at least one additive selected from the group consisting of a colorant, a charge control agent and an offset preventer, and pulverizing the kneaded resin or mixture and classifying the pulverized resin or mixture.

Further, according to the present invention, there is provided a process for the production of a toner for electrophotography, which comprises the step of polymerizing a monomer which is to form a lactic acid-based resin of the formula (1), $$H—[—O—CH(CH_3)—CO—]_n—OR \quad (1)$$

wherein R is an alkali metal or an alkaline earth metal, and n is an integer of 10 to 20,000, as a component for the toner for electrophotography, in the presence of at least one additive selected from the group consisting of a colorant, a charge control agent and an offset preventer.

DETAILED DESCRIPTION OF THE INVENTION

The present inventors have made diligent studies to accomplish the facile disposal or reclaiming of used copying paper and as a result found the following. A lactic acid obtained by the lactic acid fermentation of glucose is directly dehydratively condensed, or a cyclic dimer of lactic acid (lactide) is ring-opening polymerized, to prepare a lactic acid-based resin, and this lactic acid-based resin is incorporated into a toner as a binder, whereby the toner can be imparted with hydrolyzability and biodegradability. The so-obtained hydrolyzable and biodegradable toner can achieve the above objects.

The cyclic dimer of lactic acid (lactide) is obtained by concentrating a lactic acid aqueous solution to obtain a lactic acid polycondensate and allowing the lactic acid polycondensate to react under heat (140° to 200° C.) in the presence of a catalyst. The reaction product is distilled, recrystallized and dried, and the resultant cyclic dimer of lactic acid (lactide) is used as a monomer for the ring-opening polymerization. In the present invention, the dehydrative condensation and the ring-opening polymerization are carried out by a bulk polymerization method. In the bulk polymerization method, the monomer is polymerized in the absence of a solvent and other dispersing media. The dehydrative condensation has a problem in that it is difficult to obtain a lactic acid resin having a high molecular weight since the polymerization and the depolymerization are brought into an equilibrium state when the molecular weight of the resin reaches a certain value. It is therefore preferred to employ a bulk polymerization method in which a cyclic dimer of a lactic acid is used as a monomer. For the ring-opening polymerization, a solution polymerization method may be employed, while the bulk polymerization method has the following advantages, and the present invention uses the bulk polymerization method.

a. There is no odor caused by a residual solvent when the toner is heat-fixed, which serves to maintain a clean environment of an office where a copying machine is installed.

b. There is used no solvent when the toner is heat-melted and kneaded, which serves to maintain a clean environment of a plant where the toner is produced.

c. There is used no solvent, which serves to provide the toner at a less expensive price.

The ring-opening polymerization of the lactide is preferably carried out in the presence of a tin compound. The lactic acid-based resin is produced with an apparatus such as an extruder, a pressure kneader or a Banbury mixer.

The lactic acid-based resin is available, for example, as a product supplied by SHIMADZU CORPORATION in the trade name of "Lacty". A lactic acid-based resin is easily hydrolyzable in the presence of an alkali solution, and it has an advantage in that a toner containing a colorant such as carbon black can be effectively removed from used copying paper. In the present invention, it is required to block the terminal of the lactic acid-based resin with an alkali metal or an alkaline earth metal for improving the toner in the stability of chargeability by preventing the toner from absorbing water in the atmosphere.

Specifically, at a later stage of the polymerization or during the kneading of the lactic acid-based resin whose terminal is not blocked or a mixture of said resin with the above additive under heat, an alkali metal salt or an alkaline earth metal salt is added in an amount of 0.5 to 2 mol per mole of the polymerization initiator, thereby to block the terminal of the lactic acid-based resin of the formula (I) with a carboxy salt.

The above salts include salts of hydroxides, bicarbonates, phosphates, acetates and p-toluenesulfonates. Particularly referred are sodium hydrogencarbonate, sodium phosphate, potassium bicarbonate, calcium acetate and magnesium acetate, since these have a low melting point and have excellent reactivity so that the terminal of the lactic acid-based resin can be effectively blocked with a carboxy salt.

The colorant used in the present invention includes carbon black, a monoazo red pigment, a diazo yellow pigment, a quinacridone magenta pigment and an anthraquinone pigment. The charge control agent includes a Nigrosine dye, a quaternary ammonium salt and a monoazo metal complex dye. As the offset preventer, preferred is an polyolefin having a weight average molecular weight of approximately 1,000 to 45,000. The polyolefin is required to have high dispersibility in lactic acid monomer or dimer or the lactic acid-based resin, and it increases the fusion temperature of the toner if it has too high a melting point. In view of these points, it is preferred to use a polyolefin having a proper molecular weight. The weight average molecular weight of the polyolefin is particularly preferably about 2,000 to 6,000. Further, the softening point of the polyolefin is preferably 100° to 180° C., particularly preferably 130° to 160° C.

Specific examples of the above polyolefin include polyethylene, polypropylene and polybutylene. Of these polyolefins, polypropylene is particularly preferred.

The offset preventer which can be used effectively can be further selected from fatty acid metal salts such as zinc salt, barium salt, lead salt, cobalt salt, calcium salt and magnesium salt of stearic acid, zinc salt, manganese salt, iron salt and lead salt of olefinic acid and zinc acid, cobalt salt and magnesium salt of palmitic acid; higher fatty acids having at least 16 carbon atoms; higher alcohols having at least 16 carbon atoms, esters of polyhydric or monohydric alcohols; natural or synthetic paraffins; fatty acid esters or partial saponification products thereof; and ethylene-bisstearoylamides.

The above offset preventers may be used alone or in combination. The amount of the offset preventer per 100 parts by weight of the binder resin or the monomer to constitute the binder resin is generally 0.1 to 10 parts by weight, preferably 0.5 to 5 parts by weight.

The toner for electrophotography, provided by the present invention, may contain other thermoplastic resin as a binder resin in combination with the lactic acid-based resin. The "other" thermoplastic resin includes polystyrene, polyacrylic acid ester, a styrene-acrylate copolymer, polyvinyl chloride, polyvinyl acetate, polyvinylidene chloride, a phenolic resin, an epoxy resin and a polyester resin.

When the "other" thermoplastic resin is used in combination with the lactic acid-based resin, the amount of the "other" thermoplastic resin based on the total weight of the binder reins is preferably 80% by weight or less, particularly preferably 50% by weight or less. When the amount of the "other" thermoplastic resin exceeds 80% by weight, the bonding strength thereof to a paper surface is too high, and the toner shows decreased deinking properties. When the toner of the present invention is used as a biodegradable toner, it is preferred not to incorporate the "other" thermoplastic resin.

The toner of the present invention is obtained by a method in which the additives such as the colorant, the charge control agent, the offset preventer, etc., are added, as required, to the lactic acid-based resin prepared by the polymerization in the presence of at least one additive selected from the colorant, the charge control agent and the offset preventer, the mixture is melt-kneaded, the kneaded mixture is cooled to solidify it and the solidified mixture is pulverized and classified.

Of the above two methods, the latter method has an advantage in that the additives such as the colorant, the charge control agent, the offset preventer, etc., can be contained in the binder resin in a state where these additives are remarkably uniformly dispersed in the binder resin. That is because, by polymerizing the monomer which is to give the binder resin in a state where the additives are mixed with the monomer, the additives are mixed with the monomer in a liquid state before the completion of the polymerization of the monomer. That is, when the monomer itself is in a liquid state (or it may be in a solution state), the additives can be fully uniformly dispersed in the monomer. As a result, the additives are fully uniformly dispersed among molecular chains of the resin.

When the colorant, carbon black in particular, is uniformly dispersed in the binder resin, the toner shows a decreased intrinsic volume resistance, and the toner for electrophotography exhibits stable chargeability. This is also the case with the charge control agent. When the offset preventer is uniformly dispersed in the binder resin, there can be obtained a toner for electrophotography which has non-offset properties effective for practical use and which can be fixed with a hot roller.

A fluidization agent such as hydrophobic silica or colloidal silica and a magnetic powder may be incorporated into the toner for electrophotography, provided by the present invention, in order to impart the toner with fluidity. These additives may be used in a state where the toner particle surfaces are covered with particles of these additives.

The toner for electrophotography, provided by the present invention, may be mixed with a carrier comprising an iron powder, ferrite or granulated magnetite for the use of the mixture as a two-component developer. Further, when a magnetic material is incorporated into the toner, the toner can be used as a one-component developer without mixing it with any carrier.

The present invention will be detailed hereinafter with reference to Examples, in which "part" stands for "part by weight" and "%" stands for "% by weight" unless otherwise specified.

REFERENTIAL SYNTHESIS EXAMPLE 1

| | |
|---|---|
| L-lactide (supplied by SHIMADZU CORPORATION) | 100 parts |
| Lauryl alcohol | 0.05 part |
| Tin octylate ("Cosmos 29" supplied by TH. GOLDSCHMIDT AG., catalyst for ring-opening polymerization) | 0.2 part |

A raw material having the above composition was fed to the raw material feeding port of a twin-screw kneading extruder. The cylinder temperature was set at 190° C., and the screw rotation was set at 60 rpm in one direction. A nitrogen gas was introduced through a feeding port. The average residence time in the twin-screw kneading extruder was 15 minutes. The resultant polymer was extruded through a nozzle having an opening diameter of 2 mm, and the extrudate was cooled to solidify it, and the solidified polymer was cut to give chips of a lactic acid-based resin. The so-obtained chips had a weight average molecular weight of 100,000. This resin had the formula (1) in which n was 1,400 and R was dodecyl.

COMPARATIVE EXAMPLE 1

| | |
|---|---|
| Lactic acid-based resin obtained in Referential Synthesis Example 1 | 100 parts |
| Polyolefin wax ("NP-105", supplied by MITSUI PETROCHEMICAL INDUSTRIES, LTD.) | 2 parts |
| Charge control agent ("NXVP 434", supplied by Hoechst) | 2 parts |
| Carbon black ("MA-100", supplied by MITSUBISHI KASEI CORPORATION) | 6 parts |

A raw material having the above composition was mixed with a super mixer and melt-kneaded under heat with a twin-screw kneader, and the kneaded mixture was pulverized with a jet mill. Then, the pulverized product was classified with a dry-method flush classifier to give negatively chargeable toner particles having an average particle diameter of 12 μm. 100 Parts of the so-obtained toner particles and 0.3 part of hydrophobic silica ("R972", supplied by Nippon Aerosil Co., Ltd.) were stirred with a Henschel mixer for 1 minute to allow the hydrophobic silica to adhere to the toner particles, whereby a toner (A) for electrophotography was obtained.

COMPARATIVE EXAMPLE 2

A toner (B) for electrophotography was obtained in the same manner as in Comparative Example 1 except that the amount of the lactic acid-based resin was changed to 50 parts and that 50 parts of a styrene/acrylate copolymer resin ("NC-6550" supplied by Nippon Carbide Industries Co., Inc.) was added.

COMPARATIVE EXAMPLE 3

A toner (C) for electrophotography was obtained in the same manner as in Comparative Example 1 except that the lactic acid-based resin was replaced with 100 parts of the same styrene/acrylate copolymer resin as that used in Comparative Example 2.

COMPARATIVE EXAMPLE 4

A toner (D) for electrophotography was obtained in the same manner as in Comparative Example 1 except that the lactic acid-based resin was replaced with 100 parts of a polyester resin (NCP-33B, supplied by Nippon Carbide Kogyo).

COMPARATIVE EXAMPLE 5

A toner (E) for electrophotography was obtained in the same manner as in Comparative Example 1 except that the lactic acid-based resin was replaced with 100 parts of the same styrene/acrylate copolymer resin as that used in Comparative Example 2.

SYNTHESIS EXAMPLE 1

| | |
|---|---|
| L-lactide (supplied by SHIMADZU CORPORATION) | 100 parts |
| Lauryl alcohol | 0.05 part |
| Tin octylate ("Cosmos 29" supplied by TH. GOLDSCHMIDT AG., catalyst for ring-opening polymerization) | 0.2 part |
| Carbon black ("MA-100" supplied by MITSUBISHI KASEI CORPORATION) | 6 parts |

A raw material having the above composition was fed to the raw material feeding port of a twin-screw kneading extruder. The cylinder temperature was set at 190° C., and the screw rotation was set at 60 rpm in one direction. A nitrogen gas was introduced through a feeding port. The average residence time in the twin-screw kneading extruder was 15 minutes. The resultant polymer was extruded through a nozzle having an opening diameter of 2 mm, and the extrudate was cooled to solidify it, and the solidified polymer was cut to give chips of a lactic acid-based resin. The so-obtained chips had a weight average molecular weight of 110,000. This resin had the formula (1) in which n was 1,500 and R was dodecyl.

EXAMPLE 1

| | |
|---|---|
| Lactic acid-based resin obtained in Synthesis Example 1 | 106 parts |
| Polyolefin wax ("NP-105", supplied by MITSUI PETROCHEMICAL INDUSTRIES, LTD.) | 2 parts |
| Charge control agent ("NXVP 434", supplied by Hoechst) | 2 parts |

A raw material having the above composition was mixed with a super mixer and melt-kneaded under heat with a twin-screw kneader, and the kneaded mixture was pulverized with a jet mill. Then, the pulverized product was classified with a dry-method flush classifier to give negatively chargeable toner particles having an average particle diameter of 12 μm. 100 Parts of the so-obtained toner particles and 0.3 part of hydrophobic silica ("R972", supplied by Nippon Aerosil Co., Ltd.) were stirred with a Henschel mixer for 1 minute to allow the hydrophobic silica to adhere to the toner particles, whereby a toner (F) for electrophotography was obtained.

SYNTHESIS EXAMPLE 2

| | |
|---|---|
| L-lactide (supplied by SHIMADZU CORPORATION) | 100 parts |
| Lauryl alcohol | 0.05 part |
| Tin octylate ("Cosmos 29", supplied by TH. GOLDSCHMIDT AG., catalyst for ring-opening polymerization) | 0.2 part |
| Charge control agent ("NXVP 434", supplied by Hoechst) | 2 parts |

A raw material having the above composition was fed to the raw material feeding port of a twin-screw kneading extruder. The cylinder temperature was set at 190° C., and the screw rotation was set at 60 rpm in one direction. A nitrogen gas was introduced through a feeding port. The average residence time in the twin-screw kneading extruder was 15 minutes. The resultant polymer was extruded through a nozzle having an opening diameter of 2 mm, and the extrudate was cooled to solidify it, and the solidified polymer was cut to give chips of a lactic acid-based resin. The so-obtained chips had a weight average molecular weight of 110,000. This resin had the formula (1) in which n was 1,500 and R was dodecyl.

EXAMPLE 2

| | |
|---|---|
| Lactic acid-based resin obtained in Synthesis Example 2 | 102 parts |
| Carbon black ("MA-100", supplied by MITSUBISHI KASEI CORPORATION) | 6 parts |

-continued

| | |
|---|---|
| Polyolefin wax ("NP-105", supplied by MITSUI PETROCHEMICAL INDUSTRIES, LTD.) | 2 parts |

A raw material having the above composition was mixed with a super mixer and melt-kneaded under heat with a twin-screw kneader, and the kneaded mixture was pulverized with a jet mill. Then, the pulverized product was classified with a dry-method flush classifier to give negatively chargeable toner particles having an average particle diameter of 12 μm. 100 Parts of the so-obtained toner particles and 0.3 part of hydrophobic silica ("R972", supplied by Nippon Aerosil Co., Ltd.) were stirred with a Henschel mixer for 1 minute to allow the hydrophobic silica to adhere to the toner particles, whereby a toner (G) for electrophotography was obtained.

SYNTHESIS EXAMPLE 3

| | |
|---|---|
| L-lactide (supplied by SHIMADZU CORPORATION) | 100 parts |
| Lauryl alcohol | 0.05 part |
| Tin octylate ("Cosmos 29", supplied by TH. GOLDSCHMIDT AG., catalyst for ring-opening polymerization) | 0.2 part |
| Polyolefin wax ("NP-105", supplied by MITSUI PETROCHEMICAL INDUSTRIES, LTD.) | 2 parts |

A raw material having the above composition was fed to the raw material feeding port of a twin-screw kneading extruder. The cylinder temperature was set at 190° C., and the screw rotation was set at 60 rpm in one direction. A nitrogen gas was introduced through a feeding port. The average residence time in the twin-screw kneading extruder was 15 minutes. The resultant polymer was extruded through a nozzle having an opening diameter of 2 mm, and the extrudate was cooled to solidify it, and the solidified polymer was cut to give chips of a lactic acid-based resin. The so-obtained chips had a weight average molecular weight of 100,000. This resin had the formula (1) in which n was 1,400 and R was dodecyl.

EXAMPLE 3

| | |
|---|---|
| Lactic acid-based resin obtained in synthesis Example 3 | 102 parts |
| Carbon black ("MA-100", supplied by MITSUBISHI KASEI CORPORATION) | 6 parts |
| Charge control agent ("NXVP 434", supplied by Hoechst) | 2 parts |

A raw material having the above composition was mixed with a super mixer and melt-kneaded under heat with a twin-screw kneader, and the kneaded mixture was pulverized with a jet mill. Then, the pulverized product was classified with a dry-method flush classifier to give negatively chargeable toner particles having an average particle diameter of 12 μm. 100 Parts of the so-obtained toner particles and 0.3 part of hydrophobic silica ("R972", supplied by Nippon Aerosil Co., Ltd.) were stirred with a Henschel mixer for 1 minute to allow the hydrophobic silica to adhere to the toner particles, whereby a toner (H) for electrophotography was obtained.

SYNTHESIS EXAMPLE 4

| | |
|---|---|
| L-lactide (supplied by SHIMADZU CORPORATION) | 100 parts |
| Lauryl alcohol | 0.05 part |
| Tin octylate ("Cosmos 29" supplied by TH. GOLDSCHMIDT AG., catalyst for ring-opening polymerization) | 0.2 part |
| Carbon black ("MA-100", supplied by MITSUBISHI KASEI CORPORATION) | 6 parts |
| Polyolefin wax ("NP-105", supplied by MITSUI PETROCHEMICAL INDUSTRIES, LTD.) | 2 parts |
| Charge control agent ("NXVP 434", supplied by Hoechst) | 2 parts |

A raw material having the above composition was fed to the raw material feeding port of a twin-screw kneading extruder. The cylinder temperature was set at 190° C., and the screw rotation was set at 60 rpm in one direction. A nitrogen gas was introduced through a feeding port. The average residence time in the twin-screw kneading extruder was 15 minutes. The resultant polymer was extruded through a nozzle having an opening diameter of 2 mm, and the extrudate was cooled to solidify it, and the solidified polymer was cut to give chips of a lactic acid-based resin. The so-obtained chips had a weight average molecular weight of 120,000. This resin had the formula (1) in which n was 1,650 and R was dodecyl.

EXAMPLE 4

A raw material composed of the lactic acid-based resin obtained in Synthesis Example 4 was mixed with a super mixer and melt-kneaded under heat with a twin-screw kneader, and the kneaded mixture was pulverized with a jet mill. Then, the pulverized product was classified with a dry-method flush classifier to give negatively chargeable toner particles having an average particle diameter of 12 μm. 100 Parts of the so-obtained toner particles and 0.3 part of hydrophobic silica ("R972", supplied by Nippon Aerosil Co., Ltd.) were stirred with a Henschel mixer for 1 minute to allow the hydrophobic silica to adhere to the toner particles, whereby a toner (I) for electrophotography was obtained.

COMPARATIVE EXAMPLE 6

| | |
|---|---|
| Lactic acid-based resin obtained in Referential Synthesis Example 1 | 100 parts |
| Natural wax ("Rice Wax, supplied by Noda Wax Co., Ltd.) | 2 parts |
| Charge control agent ("NXVP 434", supplied by Hoechst) | 2 parts |

A white toner (J) having an average particle diameter of 12 μm was obtained from a raw material having the above composition in the same manner as in Comparative Example 1.

COMPARATIVE EXAMPLE 7

A white toner (K) having an average particle diameter of 12 μm was obtained in the same manner as in Comparative Example 3 except that no carbon black was used.

SYNTHESIS EXAMPLE 5

| | |
|---|---|
| L-lactide | 100 parts |
| Tin octylate | 0.2 part |

A raw material having the above composition was fed to a twin-screw extruder through a feeding port, and 0.2 part of sodium bicarbonate was fed through a second feeding port.

The cylinder temperature was set at 190° C., the screws were rotated at 60 rpm in one direction, and nitrogen gas was introduced through a supplying port. The average residence time of the materials was 15 minutes. The resultant polymer was extruded through a nozzle having a opening diameter of 2 mm, cooled to solidness and cut to give lactic acid-based resin chips. The lactic acid-based resin had an weight average molecular weight of 120,000. This resin had the formula (I) in which n was 1,650 and R was sodium.

SYNTHESIS EXAMPLE 6

A lactic acid-based resin was obtained in the same manner as in Synthesis example 5 except that the sodium bicarbonate was replaced with calcium acetate. The lactic acid-based resin had an weight average molecular weight of 110,000. This resin had the formula (I) in which n was 1,500 and R was calcium.

EXAMPLE 5

A toner (L) for electrophotography was obtained in the same manner as in Comparative Example 1 except that the lactic acid-based resin was replaced with the lactic acid-based resin obtained in Synthesis Example 5.

ESXMAPLE 6

A toner (M) for electrophotography was obtained in the same manner as in Comparative Example 1 except that the lactic acid-based resin was replaced with the lactic acid-based resin obtained in Synthesis Example 6.

EXAMPLE 7

A white toner (N) having an average particle diameter of 12 μm was obtained in the same manner as in Comparative Example 6 except that the lactic acid-based resin was replaced with the lactic acid-based resin obtained in Synthesis Example 5.

EXAMPLE 8

A white toner (O) having an average particle diameter of 12 μm was obtained in the same manner as in Comparative Example 6 except that the lactic acid-based resin was replaced with the lactic acid-based resin obtained in Synthesis Example 6.

The toners for electrophotography obtained in the above Examples and Comparative Examples were tested as follows.

(1) Deinking Properties

The toners for electrophotography, obtained in Examples 1 to 4 and Comparative Examples 1 to 5 were used for forming test images having a black and white ratio of 6% on surfaces of paper sheets having a weight of 75 g/m$^2$ to prepare test sheets. Then, hand-made paper sheets were prepared from these test sheets under the following conditions.

Defibering: An aqueous dispersion containing 5.0% of the test sheet, 0.7% of NaOH, 3.0% of sodium silicate, 3.0% of $H_2O_2$ and 0.2% of a deinking agent ("Liptol" S2800, supplied by LION CORPORATION) was stirred in a beaker at 50° C. for 20 minutes.

Dilution-Dehydration-Kneader treatment: Water was added to the aqueous dispersion such that the aqueous dispersion had a solid content of 5%, and the mixture was centrifugally dehydrated. Further, pulp, sodium silicate, etc., were added such that the mixture had a pulp content of 20%, a sodium silicate content of 3.0% and an NaOH content of 0.5%, and these components were disaggregated with a kneader.

Aging: The disaggregation mixture was aged at 50° C. for 2 hours.

Floatation: Water was added to the aged product to prepare a dispersion having a pulp concentration of 1%, and fine air bubbles were introduced into the dispersion for 7 minutes to allow the bubbles to adsorb the toner. The bubbles adsorbing the toner went upward and floated on the water surface, whereby the toner and the water were separated.

Washing: 2.4 Grams of the deinked pulp was washed with 1 liter of water twice.

Preparation of hand-made sheet: A hand-made sheet having a basis weight of 100 $gm^2$ was prepared with a TAPPI sheet machine.

Evaluation of deinking properties: The numbers of toner spots having a diameter of more than 100 μm (visually detectable size) and a diameter of 60 to 100 μm present on the hand-made sheet having an area of 9 $cm^2$ were counted visually and through a microscope.

Table 1 shows the above test results. Each value in Table 1 shows the number of remaining toner spots.

TABLE 1

| | 60~100 μm Number | More than 100 μm Number | Total Number |
|---|---|---|---|
| CEx. 1 | 9 | 6 | 15 |
| CEx. 2 | 10 | 10 | 20 |
| CEx. 4 | 30 | 28 | 58 |
| Ex. 1 | 8 | 6 | 14 |
| Ex. 2 | 10 | 5 | 15 |
| Ex. 3 | 10 | 4 | 14 |
| Ex. 4 | 8 | 5 | 13 |
| CEx. 3 | 34 | 28 | 62 |
| CEx. 5 | 28 | 25 | 53 |
| Ex. 5 | 8 | 9 | 17 |
| Ex. 6 | 10 | 8 | 18 |

Ex. = Example, CEx. = Comparative Example

Table 1 clearly shows that the toner for electrophotography, provided by the present invention, shows excellent deinking properties.

(2) Biodegradability

Each of toners (A) to (M) was individually melt-molded into a film having a thickness of about 50 μm, and allowed to remain in soil for 6 months.

The films from the toners (A), (D), (F), (G), (H), (I), (J), (L) and (M) completely disappeared in form, and the film from the toner (B) also mostly disappeared in form, while the films from the comparative toners (C), (E) and (K) remained intact in form. The white toners (J), (K), (N) and (O) were allowed themselves to remain in soil for 3 months. The white toners (J), (N) and (O) were completely decomposed, while the white toner (K) was not decomposed.

(3) Observation of Colorant Dispersion State

The kneaded mixture (not pulverized) obtained in Comparative Examples 1 and 2 and Examples 1 and 4 were cut to a thickness of 0.5 μm, and their cross sections were observed through an optical microscope (400 times). Table 2 shows the number of dispersed carbon black particles in the field of microscopic vision. Headings in Table 2 show the diameters of the carbon black particles and numbers of carbon black particles having these diameters.

TABLE 2

| | Over 10 μm | 10~5 μm | Below 5 μm |
|---|---|---|---|
| CEx. 1 | 7 | 21 | Abundant |
| CEx. 2 | 6 | 13 | Abundant |
| Ex. 1 | 0 | 4 | Abundant |
| Ex. 4 | 0 | 3 | Abundant |

Ex. = Example, CEx. = Comparative Example

Table 2 shows that the dispersion states in Examples 1 and 4 were excellent.

(4) Image Quality and Utilization

4 Parts of each of the toners obtained in Examples 1, 2 and 3 and Comparative Examples 1 and 2 was separately mixed with 96 parts of a ferrite carrier ("F1530", supplied by POWDERTECH CO., LTD.) to prepare two-component developers for image evaluation. The so-obtained developers were evaluated with an electronic copying machine ("BD-3810", supplied by TOSHIBA CORPORATION) to give excellent background-free images having a high image density.

Table 3 shows the image quality of the initial copy and 5,000th copy.

The properties were evaluated as follows.

Triboelectric charge: Measured with a blow-off frictional charge measuring apparatus supplied by Toshiba Chemical Co., Ltd.

Image density: Measured with a reflection densitometer "RD-914" supplied by Macbeth.

Background: Measured with a color difference meter "Z-1001DP" supplied by NIPPON DENSHOKU KOGYO CO., LTD.

TABLE 3

| | Toner density in developer | | Tribo-electric charge (μc/g) | | Image density | | Background | |
|---|---|---|---|---|---|---|---|---|
| | In-itial, | 5000th | In-itial, | 5000th | In-itial, | 5000th | in-itial, | 5000th |
| CEx. 1 | 4.0 | 4.4 | −21.8 | −18.6 | 1.42 | 1.45 | 0.68 | 0.82 |
| CEx. 2 | 4.0 | 4.2 | −22.4 | −21.2 | 1.41 | 1.42 | 0.62 | 0.75 |
| Ex. 1 | 4.0 | 4.1 | −22.3 | −21.5 | 1.42 | 1.43 | 0.41 | 0.52 |
| Ex. 2 | 4.0 | 3.9 | −23.5 | −24.2 | 1.41 | 1.42 | 0.48 | 0.60 |
| Ex. 3 | 4.0 | 4.2 | −22.5 | −21.2 | 1.42 | 1.44 | 0.52 | 0.65 |
| Ex. 4 | 4.0 | 3.9 | −23.4 | −24.0 | 1.42 | 1.42 | 0.33 | 0.45 |
| Ex. 5 | 4.0 | 3.9 | −21.8 | −22.0 | 1.42 | 1.41 | 0.56 | 0.60 |
| Ex. 6 | 4.0 | 3.9 | −22.1 | −22.4 | 1.41 | 1.41 | 0.58 | 0.61 |

Table 3 shows that the toners obtained in Examples 1 to 6 gave excellent images free of background.

(5) Environmental Dependency Test

The toners obtained in Examples 5 and 6 and Comparative Examples 1 and 4 were evaluated in the same manner as in (4) Image quality and Utilization under testing environmental conditions of a low temperature and a low humidity (10° C., 30%RH) or a high temperature and a high humidity (35° C., 85%RH).

Table 4 and 5 show the image quality of the initial copy and 3,000th copy obtained under environmental conditions of a low temperature and a low humidity (10° C., 30%RH) or a high temperature and a high humidity (35° C., 85% RH).

TABLE 4

10°C., 30% RH)

| | Toner density in developer | | Tribo-electric charge (μc/g) | | Image density | | Background | |
|---|---|---|---|---|---|---|---|---|
| | In-itial, | 3000th | In-itial, | 3000th | In-itial, | 3000th | in-itial, | 3000th |
| Ex. 5 | 4.0 | 4.0 | −22.4 | −23.6 | 1.42 | 1.41 | 0.56 | 0.59 |
| Ex. 6 | 4.0 | 4.1 | −21.9 | −23.4 | 1.42 | 1.41 | 0.58 | 0.62 |
| CEx. 1 | 4.0 | 4.1 | −22.1 | −24.5 | 1.42 | 1.37 | 0.60 | 0.65 |
| CEx. 4 | 4.0 | 3.8 | −22.2 | −26.5 | 1.41 | 1.30 | 0.57 | 0.60 |

Ex. = Example, CEx. = Comparative Example

TABLE 5

(35° C., 85% RH)

| | Toner density in developer | | Tribo-electric charge (μc/g) | | Image density | | Background | |
|---|---|---|---|---|---|---|---|---|
| | In-itial, | 3000th | In-itial, | 3000th | In-itial, | 3000th | in-itial, | 3000th |
| Ex. 5 | 4.0 | 4.1 | −21.5 | −21.0 | 1.42 | 1.42 | 0.62 | 0.68 |
| Ex. 6 | 4.0 | 4.1 | −21.3 | −20.9 | 1.42 | 1.42 | 0.63 | 0.66 |
| CEx. 1 | 4.0 | 4.4 | −21.5 | −18.4 | 1.41 | 1.44 | 0.65 | 0.85 |
| CEx. 4 | 4.0 | 4.2 | −21.0 | −15.3 | 1.41 | 1.47 | 0.59 | 1.05 |

Ex. = Example, CEx. = Comparative Example

The toner in Comparative Example 4 is liable to show a decrease in image density in a low-temperature low-humidity environment. Further, the toner in Comparative Example 4 an increase in background in a high-temperature high-humidity environment due to a decrease in triboelectric charge. The toners in Examples 5 and 6 are free from dependency on any one of the above environmental conditions and show excellent image quality.

The toner for electrophotography composed mainly of a lactic acid-based resin, provided by the present invention, reacts with water in an alkaline aqueous solution, and the resin molecules are hydrolyzed to decrease the bonding strength. Therefore, it can permit the facile deinking with an existing deinking system. As a result, the recycling of used copying paper is advantageously advanced. Further, the toner of the present invention is biodegradable, and has advantages in that a recovered toner can be disposed of without any problem and that waste paper can be disposed of without any problem.

What is claimed is:

1. A toner for electrophotography, which contains, as a binder resin, a lactic acid-based resin of the formula (1), $$H—[—O—CH(CH_3)—CO—]_n—OR \quad (1)$$

wherein R is an alkali metal or an alkaline earth metal, and n is an integer of 10 to 20,000.

2. A toner according to claim 1, wherein the toner further contains a colorant, a charge control agent and an offset preventer.

3. A toner according to claim 2, wherein the colorant is at least one member selected from the group consisting of carbon black, a monoazo red pigment, a disazo yellow pigment, a quinacridone magenta pigment and an anthraquinone pigment.

4. A toner according to claim 2, wherein the charge control agent is at least one member selected from the group consisting of a Nigrosine dye, a quaternary ammonium salt and a monoazo metal complex dye.

5. A toner according to claim 2, wherein the offset preventer is a polyolefin having a weight average molecular weight of 1,000 to 45,000.

6. A toner according to claim 2, wherein the offset preventer is at least one member selected from the group consisting of fatty acid metal salts, higher fatty acids, higher alcohols, esters of polyhydric or monohydric alcohols, natural or synthetic paraffins, fatty acid esters or partial saponification products thereof and ethylenebisstearoylamides.

7. A toner according to claim 1, wherein the binder resin contains a thermoplastic resin other than the lactic acid-based resin in an amount of 80% by weight or less based on the binder resin.

8. A toner for electrophotography, which contains, as a binder resin, a lactic acid-based resin of the formula (1), $$H—[—O—CH(CH_3)—CO—]_n—OR \quad (1)$$

wherein R is an alkali metal or an alkaline earth metal, and n is an integer of 10 to 20,000, said resin being produced by bulk-polymerizing lactic acid in the presence of at least one additive selected from the group consisting of a colorant, a charge control agent and an offset preventer, said toner being produced by heat-melting and kneading said resin or a mixture of said resin with at least one additive selected from the group consisting of a colorant, a charge control agent and an offset preventer, and pulverizing the kneaded resin or mixture and classifying the pulverized resin or mixture.

* * * * *